US009141127B2

(12) United States Patent
Kim

(10) Patent No.: US 9,141,127 B2
(45) Date of Patent: Sep. 22, 2015

(54) PEDAL EFFORT ADJUSTING APPARATUS OF ACCELERATOR PEDAL

(71) Applicant: Hyundai Motor Company, Seoul (KR)

(72) Inventor: Eun Sik Kim, Gwangmyeong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 62 days.

(21) Appl. No.: 13/964,765

(22) Filed: Aug. 12, 2013

(65) Prior Publication Data

US 2014/0373667 A1 Dec. 25, 2014

(30) Foreign Application Priority Data

Jun. 24, 2013 (KR) ..... 10-2013-0072561

(51) Int. Cl.
*G05G 1/30* (2008.04)
*G05G 1/40* (2008.04)

(52) U.S. Cl.
CPC ..... *G05G 1/40* (2013.01); *Y10T 74/20534* (2015.01)

(58) Field of Classification Search
USPC ..... 74/512, 513, 560
See application file for complete search history.

(56) References Cited

U.S. PATENT DOCUMENTS

2008/0276750 A1* 11/2008 Kim et al. ..... 74/513
2010/0300240 A1* 12/2010 Kim et al. ..... 74/513
2011/0094331 A1* 4/2011 Kim et al. ..... 74/513

FOREIGN PATENT DOCUMENTS

KR 10-2005-0031261 A 4/2005
KR 10-0724700 B1 6/2007
KR 10-0851321 B1 8/2008
KR 10-2011-0092098 A 8/2011
KR 10-2013-0053996 A 5/2013
KR 10-2013-0057129 A 5/2013
KR 10-2013-0063908 A 6/2013

* cited by examiner

*Primary Examiner* — Vicky Johnson
(74) *Attorney, Agent, or Firm* — Morgan, Lewis & Bockius LLP

(57) ABSTRACT

An accelerator pedal effort adjusting apparatus can easily adjust the elasticity of an elastic member by changing the length of the elastic member according to a simple rotation of a movable plate, thereby easily adjusting the accelerator pedal effort as desired. The apparatus can be commonly used with various types of accelerator pedals. The apparatus includes: a guide rod installed such that it is mounted to the bottom surface of the inner space of a pedal arm housing and is directed toward a pedal aim; a movable plate movably fitted over the guide rod such that the movable plate can be moved along the guide rod; and an elastic member installed in such a way that the elastic member is supported by both the pedal arm and the movable plate at opposite ends thereof, and applies a reaction force to a pedal pad.

6 Claims, 6 Drawing Sheets

PEDAL EFFORT ADJUSTING APPARATUS OF ACCELERATOR PEDAL

CROSS-REFERENCE TO RELATED APPLICATION

The present application claims priority of Korean Patent Application Number 10-2013-0072561 filed Jun. 24, 2013, the entire contents of which application is incorporated herein for all purposes by this reference.

BACKGROUND OF INVENTION

1. Field of Invention

The present invention relates, in general, to a pedal effort adjusting apparatus of an accelerator pedal, which can adjust the pedal effort of an accelerator pedal in response to a simple manipulation of a user.

2. Description of Related Art

FIG. 1 illustrates an example of conventional accelerator pedals of vehicles. As shown in FIG. 1, the conventional accelerator pedal includes: a pedal housing 1 that is fixedly mounted to a body panel placed below a driver's seat; a pedal arm 2, a first end of which is provided with a pedal pad 2*a*, and a second end of which is inserted into the pedal arm housing 1 and is mounted such that the pedal arm 2 can be rotated relative to the pedal arm housing 1; a spring plate 3 that is mounted to the second end of the pedal arm 2 placed inside the pedal aim housing 1; a friction shoe 4 that is mounted to the end of the pedal arm 2 placed in the pedal arm housing 1 and comes into frictional contact with the inner surface of the pedal arm housing 1 when the pedal arm 2 is rotated; and an elastic member 5 that is installed in such a way that a first end thereof is supported by the spring plate 3, and a second end thereof is supported by the inner surface of the pedal arm housing 1 which faces the spring plate 3, wherein the elastic member 5 comprises an inner spring 5*a* and an outer spring 5*b*.

When the pedal arm 2 of the conventional accelerator pedal having the above-mentioned construction is rotated around the hinge shaft 2*b*, the sum of a reaction force of the friction shoe 4 that comes into frictional contact with the inner surface of the pedal arm housing 1 and a reaction force that is generated by elastic compression of both the inner spring 5*a* and the outer spring 5*b* forms a pedal effort that is applied to the pedal arm 2.

However, the conventional accelerator pedal is problematic in that, when the pedal effort is too high, a driver is required to apply a high level of force to the pedal arm 2, and so the driver may easily feel fatigue from repeated manipulation of the accelerator pedal, and when the pedal effort is too low, the driver may not efficiently sense the feeling of accelerator pedal manipulation. In an effort to solve the problems, vehicle manufacturing companies in various countries manufacture vehicles in which the accelerator pedals have been completely assembled with fixed pedal effort characteristics so as to meet the respective safety laws and regulations of the various countries.

However, the conventional accelerator pedal that has been completely assembled with fixed pedal effort characteristics is problematic in that it is impossible to adjust the pedal effort, and so the accelerator pedal having the fixed pedal effort characteristics may not be used ubiquitously.

The information disclosed in this Background section is only for enhancement of understanding of the general background of the invention and should not be taken as an acknowledgement or any form of suggestion that this information forms the prior art already known to a person skilled in the art.

BRIEF SUMMARY

Accordingly, the present invention has been made keeping in mind the above problems occurring in the related art, and various aspects of the present invention are intended to propose a pedal effort adjusting apparatus of an accelerator pedal, which can efficiently adjust the pedal effort of the assembled accelerator pedal when necessary, and so the apparatus can efficiently meet the safety laws and regulations relating to pedal efforts in a country, and can realize the ubiquitous use of the accelerator pedal.

Various aspects of the present invention provide for a pedal effort adjusting apparatus of an accelerator pedal, including: a guide rod installed such that the guide rod is mounted to a bottom surface of an inner space of a pedal aim housing and is directed toward a pedal arm; a movable plate movably fitted over the guide rod such that the movable plate can be moved along the guide rod; and an elastic member installed in such a way that the elastic member is supported by both the pedal arm and the movable plate at opposite ends thereof, and applies a reaction force to the pedal pad connected to the pedal arm.

In the pedal effort adjusting apparatus, external threads may be formed around the outer circumferential surface of the guide rod, and internal threads may be formed around the inner circumferential surface of the movable plate such that the internal threads are movably engaged with the external threads.

Further, a plurality of adjustment teeth may be formed around the outer circumferential surface of the movable plate in radial directions while being circumferentially spaced apart from each other at regular intervals.

In the pedal effort adjusting apparatus, a tool insert hole may be formed in a side surface of the pedal arm housing so as to communicate the inner space of the pedal arm housing with the outside of the pedal arm housing, wherein one of the adjustment teeth is exposed to the outside of the pedal arm housing through the tool insert hole.

The pedal effort adjusting apparatus may further include a cover cap removably combined with the pedal arm housing so as to cover the tool insert hole.

Here, a cap protrusion may protrude from the cover cap such that the cap protrusion can be inserted into the tool insert hole, and a tooth insert hole may be formed in the cap protrusion such that one of the adjustment teeth can be inserted into the tooth insert hole.

In the pedal effort adjusting apparatus, the width of the tooth insert hole may be determined as a size that can bring opposite side surfaces of each of the adjustment teeth into close contact with opposite inner side surfaces of the tooth insert hole so as to prevent the movable plate from being rotated, and the height of the tooth insert hole may be determined as a size larger than a vertical thickness of each of the adjustment teeth such that the tooth insert hole can absorb a positional movement of the movable plate during a process of adjusting the pedal effort.

The pedal effort adjusting apparatus of the accelerator pedal according to the present invention is advantageous in that the elasticity of the elastic member can be easily adjusted by changing the length of the elastic member according to a simple rotation of the movable plate, thereby easily and efficiently adjusting the accelerator pedal effort as desired, and in that the pedal effort adjusting apparatus can be commonly used with various types of accelerator pedals.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
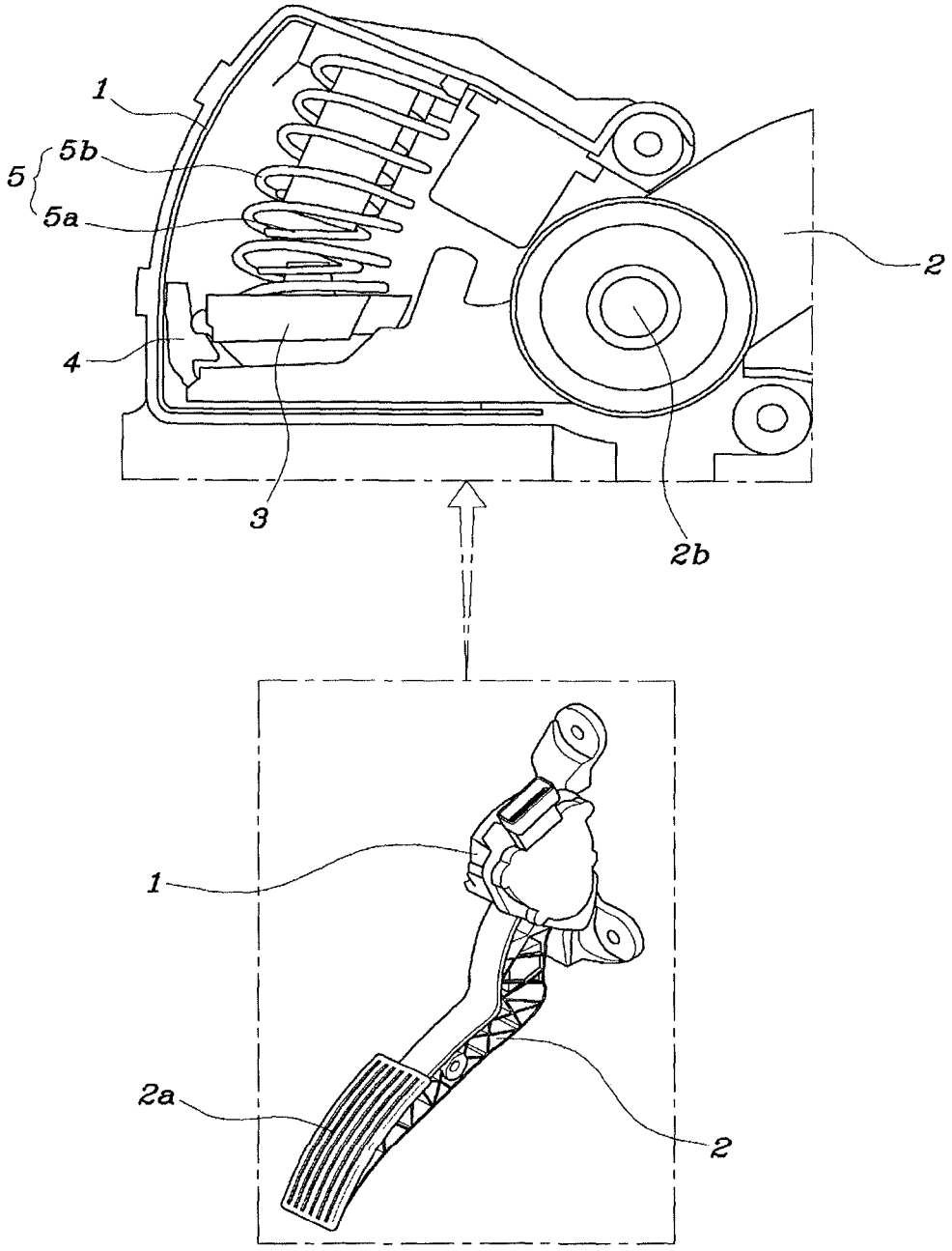
FIG. 1 (Related Art)
FIG. 1 is a view illustrating a conventional accelerator pedal of a vehicle, in which the pedal effort cannot be adjusted.
Figure 2:
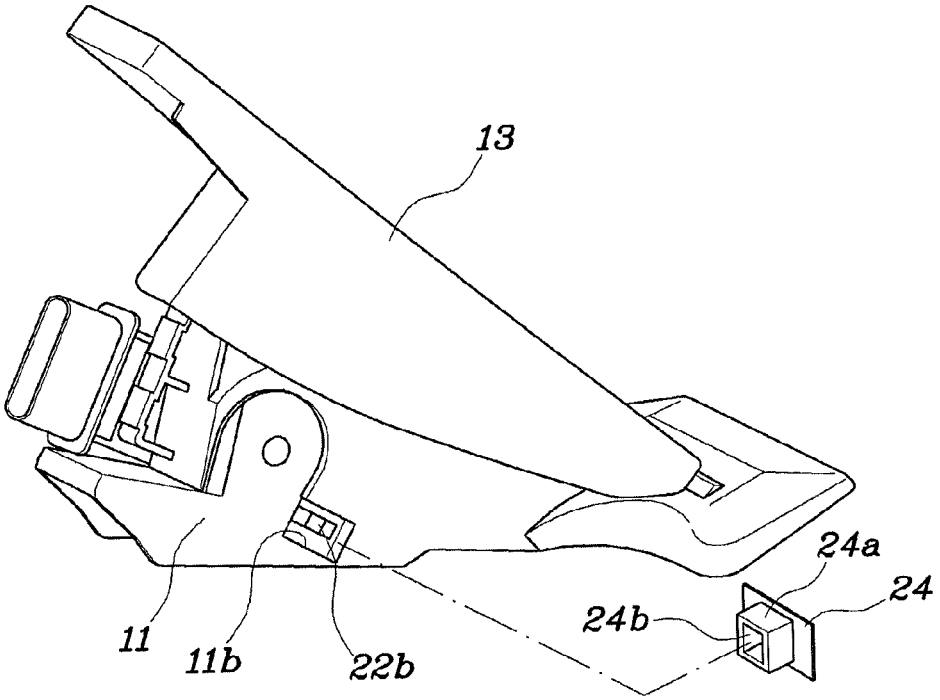
FIGS. 2, 3, 4, 5 and 6 are views illustrating a pedal effort adjusting apparatus of an exemplary accelerator pedal according to the present invention.
Figure 3:
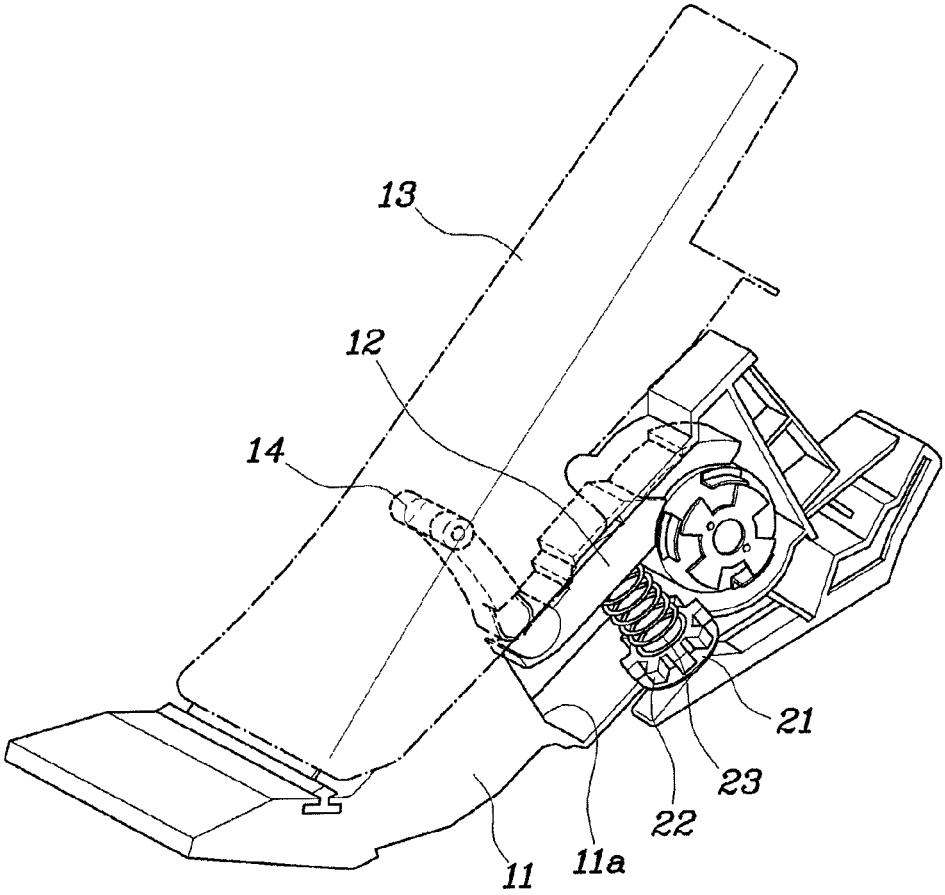
Figure 4:
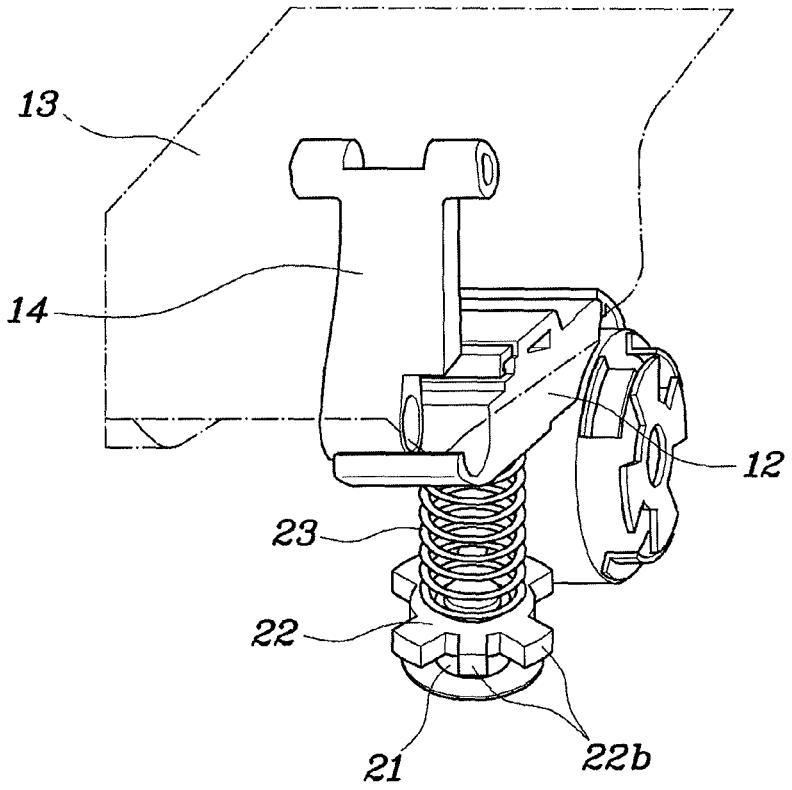

FIGS. 2 and 3 illustrate the construction of an organ type accelerator pedal that is an example of accelerator pedals of vehicles. As shown in FIGS. 2 and 3, the accelerator pedal comprises: a pedal arm housing 11 that is fixedly mounted to a body panel placed below a driver's seat, and has an inner space 11*a*; a pedal arm 12 that is rotatably mounted in the inner space 11*a* of the pedal arm housing 11; a pedal pad 13 that is rotatably mounted to the pedal arm housing 11 at a first end thereof; and a carrier 14 that connects the first end of the pedal arm 12 to the pedal pad 13 in a state in which the carrier 14 passes through the pedal arm housing 11.

The basic construction of a pendant type accelerator pedal includes a pedal arm housing, a pedal arm and a pedal pad in the same manner as that described for the organ type accelerator pedal, and so the pedal effort adjusting apparatus of the present invention can be used with accelerator pedals of vehicles, regardless of whether the accelerator pedals are organ type pedals or pendant type pedals.

As shown in FIGS. 2 to 6, the pedal effort adjusting apparatus according to the present invention includes: a guide rod 21 that is installed in such a way that a first end thereof is mounted to the bottom surface of the inner space 11*a* of the pedal arm housing 11, and a second end thereof is directed toward the pedal arm 12; a movable plate 22 that is movably fitted over the guide rod 21 such that the movable plate 22 can be moved along the guide rod 21; and an elastic member 23 that is supported by the pedal arm 12 and the movable plate 22 at opposite ends thereof, and applies a reaction force to the pedal pad 13 connected to the pedal arm 12.

External threads 21*a* are formed around the outer circumferential surface of the guide rod 21, and internal threads 22*a* are formed around the inner circumferential surface of the movable plate 22, in which the internal threads 22*a* are movably engaged with the external threads 21*a*.

Figure 5:
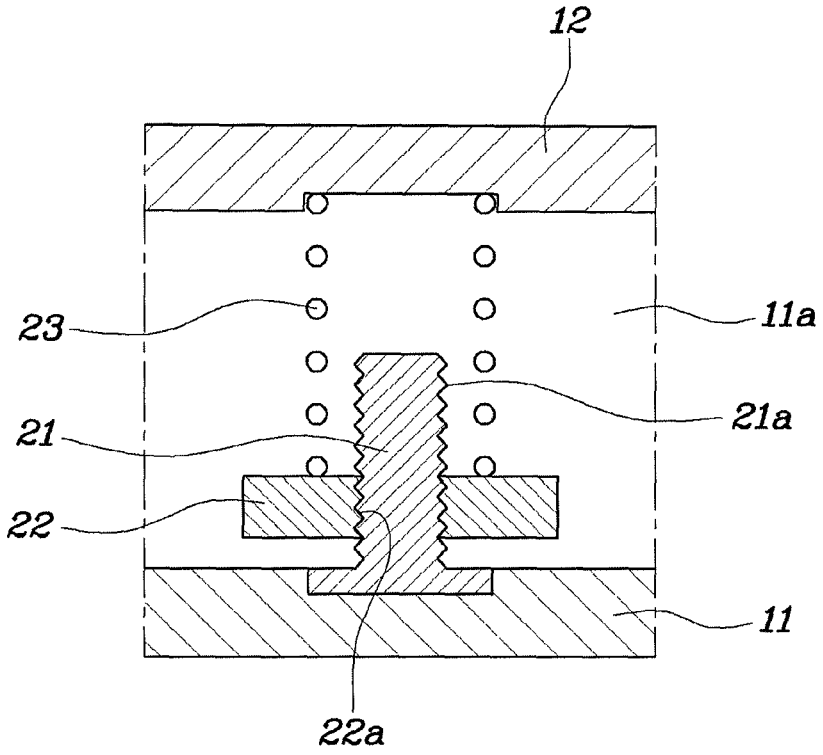

Accordingly, when the movable plate 22 is rotated, the movable plate 22 is moved along the guide rod 21 upwardly or downwardly from the position shown in FIG. 5. When the movable plate 22 is moved upwardly, the elastic member 23 is compressed and the length thereof is reduced. On the contrary, when the movable plate 22 is moved downwardly, the elastic member 23 is extended and the length thereof is increased.

When the length of the elastic member 23 is reduced, the pedal effort is increased. On the contrary, when the length of elastic member 23 is increased, the pedal effort is reduced.

To provide an efficient pedal effort, the elastic member 23 may comprise an outer spring and an inner spring, in the same manner as that described for the related art technique.

A plurality of adjustment teeth 22*b* is formed around the outer circumferential surface of the movable plate 22 in radial directions while being circumferentially spaced apart from each other at regular intervals.

The adjustment teeth 22*b* are parts that are engaged with a tool when it is required to rotate the movable plate 22.

A tool insert hole 11*b* is formed in a side surface of the pedal arm housing 11 so as to communicate the inner space 11*a* with the outside of the pedal arm housing 11. One of the adjustment teeth 22*b* is exposed to the outside of the pedal arm housing 11 through the tool insert hole 11*b*.

Further, the pedal effort adjusting apparatus according to the present invention further includes a cover cap 24 that is removably combined with the pedal arm housing 11 so as to cover the tool insert hole 11*b*.

A cap protrusion 24*a* integrally protrudes from the cover cap 24 such that the cap protrusion 24*a* can be inserted into the tool insert hole 11*b*. One will appreciate that such integral components may be monolithically formed. Further, a tooth insert hole 24*b* is formed in the cap protrusion 24*a* such that one of the adjustment teeth 22*b* can be inserted into the tooth insert hole 24*b*.

Here, the width L1 of the tooth insert hole 24*b* may be determined as a size that can bring opposite side surfaces of each adjustment tooth 22*b* into close contact with opposite inner side surfaces of the tooth insert hole 24*b* in an effort to prevent the movable plate 22 from being rotated.

Further, the height L2 of the tooth insert hole 24*b* may be determined as a size larger than a vertical thickness T1 of each adjustment tooth 22*b* such that the tooth insert hole 24*b* can absorb a positional movement of the movable plate 22 during a process of adjusting the pedal effort.

Hereinbelow, the operation of the present invention will be described with reference to the accompanying drawings.

When a user removes the cover cap 24 from the pedal arm housing 11 so as to perform pedal effort adjustment work, one of the adjustment teeth 22*b* of the movable plate 22 is exposed to the outside of the pedal arm housing 11 through the tool insert hole 11*b*.

In the above state, the user can rotate the movable plate 22 clockwise or counterclockwise by manipulating the adjustment teeth 22*b*, and so the movable plate 22 can be moved along the guide rod 21.

Here, when the movable plate 22 is moved in a direction toward the pedal arm 12, the elastic member 23 is compressed and the length thereof is reduced. In the above state, the pedal effort formed by the pedal pad 13 is increased.

On the contrary, when the movable plate 22 is moved in a direction remote from the pedal arm 12, the elastic member 23 is extended and the length thereof is increased. In the above state, the pedal effort formed by the pedal pad 13 is reduced.

When finishing the pedal effort adjustment work, the user operates so that the cap protrusion 24*a* of the cover cap 24 is inserted into the tool insert hole 11*b*, thereby combining the cover cap 24 with the pedal arm housing 11.

Figure 6:
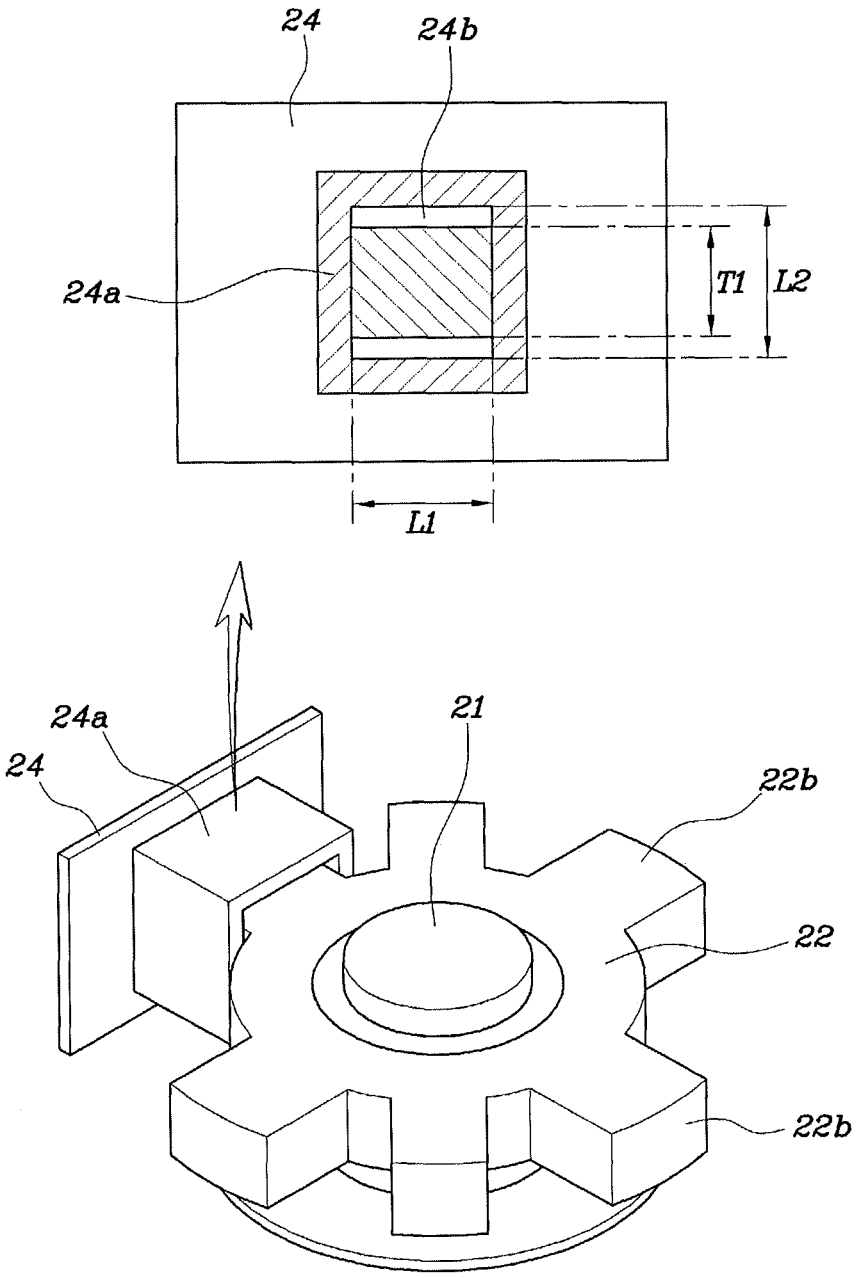

In the above state, one of the adjustment teeth 22*b* of the movable plate 22 is seated in the tooth insert hole 24*b* of the cover cap 24, as shown in FIG. 6, and so the movable plate 22 can be prevented from being undesirably rotated and the pedal effort can be maintained in the adjusted state.

As described above, the pedal effort adjusting device according to the present invention is advantageous in that the elasticity of the elastic member 23 can be easily adjusted by changing the length of the elastic member 23 according to a simple rotation of the movable plate 22, thereby easily and efficiently adjusting the accelerator pedal effort as desired.

Another advantage of the pedal effort adjusting device according to the present invention resides in that the pedal effort adjusting apparatus can efficiently meet the safety laws and regulations relating to pedal efforts in any given country and can be commonly used with various types of accelerator pedals.

For convenience in explanation and accurate definition in the appended claims, the terms inside or outside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A pedal effort adjusting apparatus for an accelerator pedal, comprising:

a pedal arm housing including an inner space;

a guide rod mounted to a bottom surface of the inner space of the pedal arm housing and directed toward a pedal arm;

a movable plate movably fitted over the guide rod such that the movable plate is moved along the guide rod; and an elastic member supported by both the pedal arm and the movable plate at opposite ends thereof, wherein the elastic member applies a reaction force to a pedal pad connected to the pedal arm, and wherein a plurality of adjustment teeth are formed around an outer circumferential surface of the movable plate in radial directions while being circumferentially spaced apart from one another at regular intervals.

2. The pedal effort adjusting apparatus of the accelerator pedal as set forth in claim 1, wherein:

external threads are formed around an outer circumferential surface of the guide rod; and internal threads are formed around an inner circumferential surface of the movable plate such that the internal threads are movably engaged with the external threads.

3. The pedal effort adjusting apparatus of the accelerator pedal as set forth in claim 1, the apparatus further comprising:

a tool insert hole formed in a side surface of the pedal arm housing providing access to the inner space of the pedal arm housing from outside the pedal arm housing, wherein one of the adjustment teeth is exposed to the outside of the pedal arm housing through the tool insert hole.

4. The pedal effort adjusting apparatus of the accelerator pedal as set forth in claim 3, further comprising:

a cover cap removably coupled with the pedal arm housing so as to cover the tool insert hole.

5. The pedal effort adjusting apparatus of the accelerator pedal as set forth in claim 4, further comprising:

a cap protrusion protruding from the cover cap such that the cap protrusion can be inserted into the tool insert hole; and a tooth insert hole formed in the cap protrusion such that one of the adjustment teeth is inserted into the tooth insert hole.

6. The pedal effort adjusting apparatus of the accelerator pedal as set forth in claim 5, wherein:

a width of the tooth insert hole is determined as a size that can bring opposite side surfaces of each of the adjustment teeth into close contact with opposite inner side surfaces of the tooth insert hole so as to prevent the movable plate from being rotated, and a height of the tooth insert hole is determined as a size larger than a vertical thickness of each of the adjustment teeth such that the tooth insert hole can absorb a positional movement of the movable plate during a process of adjusting the pedal effort.

* * * * *